US011191702B2

(12) United States Patent
Zonana et al.

(10) Patent No.: US 11,191,702 B2
(45) Date of Patent: Dec. 7, 2021

(54) MODULAR MULTI-COMPARTMENT DRUG DISPENSING APPARATUS

(71) Applicant: COMPLIANCE MEDS TECHNOLOGIES LLC, Miami, FL (US)

(72) Inventors: Moses Zonana, Hallandale Beach, FL (US); Lucas Castro, Miami, FL (US); Alex Atala, Miami, FL (US)

(73) Assignee: COMPLIANCE MEDS TECHNOLOGIES LLC, Miami, FL (US)

( * ) Notice: Subject to any disclaimer, the term of this patent is extended or adjusted under 35 U.S.C. 154(b) by 61 days.

(21) Appl. No.: 16/402,788

(22) Filed: May 3, 2019

(65) Prior Publication Data

US 2019/0336399 A1 Nov. 7, 2019

Related U.S. Application Data

(60) Provisional application No. 62/666,419, filed on May 3, 2018.

(51) Int. Cl.

| | |
|---|---|
| ***A61J 7/00*** | (2006.01) |
| ***A61J 1/03*** | (2006.01) |
| ***A61J 7/04*** | (2006.01) |

(52) U.S. Cl.

CPC ..... *A61J 7/0084* (2013.01); *A61J 1/03* (2013.01); *A61J 7/0454* (2015.05); *A61J 7/0481* (2013.01)

(58) Field of Classification Search

CPC A61J 7/0084; A61J 7/0454; A61J 1/03; A61J 7/0481

USPC ..... 700/231–244

See application file for complete search history.

(56) References Cited

U.S. PATENT DOCUMENTS

| | | | | |
|---|---|---|---|---|
| 5,782,359 | A * | 7/1998 | McAllister | B65D 41/06 206/1.5 |
| 6,021,918 | A * | 2/2000 | Dumont | A61J 7/0481 221/2 |
| 7,156,226 | B1 * | 1/2007 | Sickle | A45C 11/20 206/1.5 |
| 7,854,326 | B1 * | 12/2010 | Beckett | A61J 7/0084 206/534 |
| 8,108,068 | B1 * | 1/2012 | Boucher | G01G 17/00 700/236 |
| 8,984,919 | B2 * | 3/2015 | Jelin | E05B 65/46 70/85 |
| 9,358,499 | B2 * | 6/2016 | Akdogan | G16H 40/67 |
| 9,785,750 | B2 * | 10/2017 | Coe | A61J 1/18 |
| 10,442,592 | B2 * | 10/2019 | Atif | A61J 1/03 |

(Continued)

*Primary Examiner* — Michael Collins

(74) *Attorney, Agent, or Firm* — Leason Ellis LLP

(57) ABSTRACT

A modular dispensing apparatus for dispensing articles includes a hub containing electronics and have a plurality of side walls, with each side wall having a first coupling member that faces outward. The apparatus further includes a plurality of cartridges for holding the articles to be dispensed. Each cartridge has an inner wall that includes a second coupling member that is configured to mate with the first coupling member for detachably attaching the cartridge to a respective side wall of the hub. The cartridges are disposed radially beyond the hub such that the plurality of cartridges surround the hub. Each cartridge has an openable lid to provide access to an interior compartment of the cartridge for holding the articles.

15 Claims, 9 Drawing Sheets

(56) References Cited

U.S. PATENT DOCUMENTS

| | | | | |
|---|---|---|---|---|
| 10,555,873 | B2 * | 2/2020 | Poirier | A61J 7/0076 |
| 10,685,091 | B1 * | 6/2020 | Park, IV | A61J 7/049 |
| 2006/0058917 | A1 * | 3/2006 | Vonk | G16H 40/67<br>700/236 |
| 2009/0281657 | A1 * | 11/2009 | Gak | G16H 20/13<br>700/242 |
| 2014/0166529 | A1 * | 6/2014 | Fung | A61J 7/0076<br>206/534 |

* cited by examiner

MODULAR MULTI-COMPARTMENT DRUG DISPENSING APPARATUS

CROSS-REFERENCE TO RELATED APPLICATIONS

The present application claims priority to and the benefit of U.S. patent application Ser. No. 62/666,419, filed May 3, 2018, which is hereby incorporated by reference in its entirety.

TECHNICAL FIELD

The present invention is directed to an apparatus that is configured to dispense articles, such as pills, and more particularly, relates to a modular multi-component drug dispensing apparatus that permits different medications to be held in different disposable cartridges.

BACKGROUND

The majority of medicines and drugs require administration in a series of doses at specific times over a period of time for increased effectiveness. Outside of a hospital or clinic setting, this usually requires the patient or an individual caring for the patient to be responsible for keeping track of the medication in question. However, a frequent problem is that the patient or the individual caring for the patient errs in the administration of the medicine. Patients may forget to take a dose of their medication, be tardy in taking a dose, or forget entirely to take a dose and/or take a second dose too soon, etc.

In addition, there are a number of simple pill dispensers that are in the form of a main housing that includes seven pill compartments one for each day; however, these compartments have limited space and with many pills coming in large quantity bottles, the user has to store these large bottles and weekly add pills to the seven compartments.

SUMMARY

The present invention is broadly directed to a modular dispensing apparatus for dispensing articles (e.g., medication) that permits different medications to be held in different disposable cartridges that are detachably attached to a common hub. Electronics contained within the hub and/or the cartridges store the custom dispensing schedule for the user and are configured to alert the user when to take the medication. In addition, the dispensing events can be tacked as part of a monitoring process.

A modular dispensing apparatus for dispensing articles (e.g. medication) includes a hub containing electronics and have a plurality of side walls, with each side wall having a first coupling member that faces outward. The apparatus further includes a plurality of cartridges for holding the articles to be dispensed. Each cartridge has an inner wall that includes a second coupling member that is configured to mate with the first coupling member for detachably attaching the cartridge to a respective side wall of the hub. The cartridges are disposed radially beyond the hub such that the plurality of cartridges surround the hub. Each cartridge has an openable lid to provide access to an interior compartment of the cartridge for holding the articles.

In another aspect, a method for dispensing articles (medication) to a user comprises the steps of:

filling an interior compartment of a modular cartridge with the articles to be dispensed;

attaching the modular cartridge to a hub that is configured to be detachably attached to a plurality of modular cartridges; and alerting the user to open a respective modular cartridge at a select day and time according to a personal dispensing regimen of the user.

BRIEF DESCRIPTION OF THE DRAWING FIGURES

DETAILED DESCRIPTION OF CERTAIN EMBODIMENTS

Figure 1:
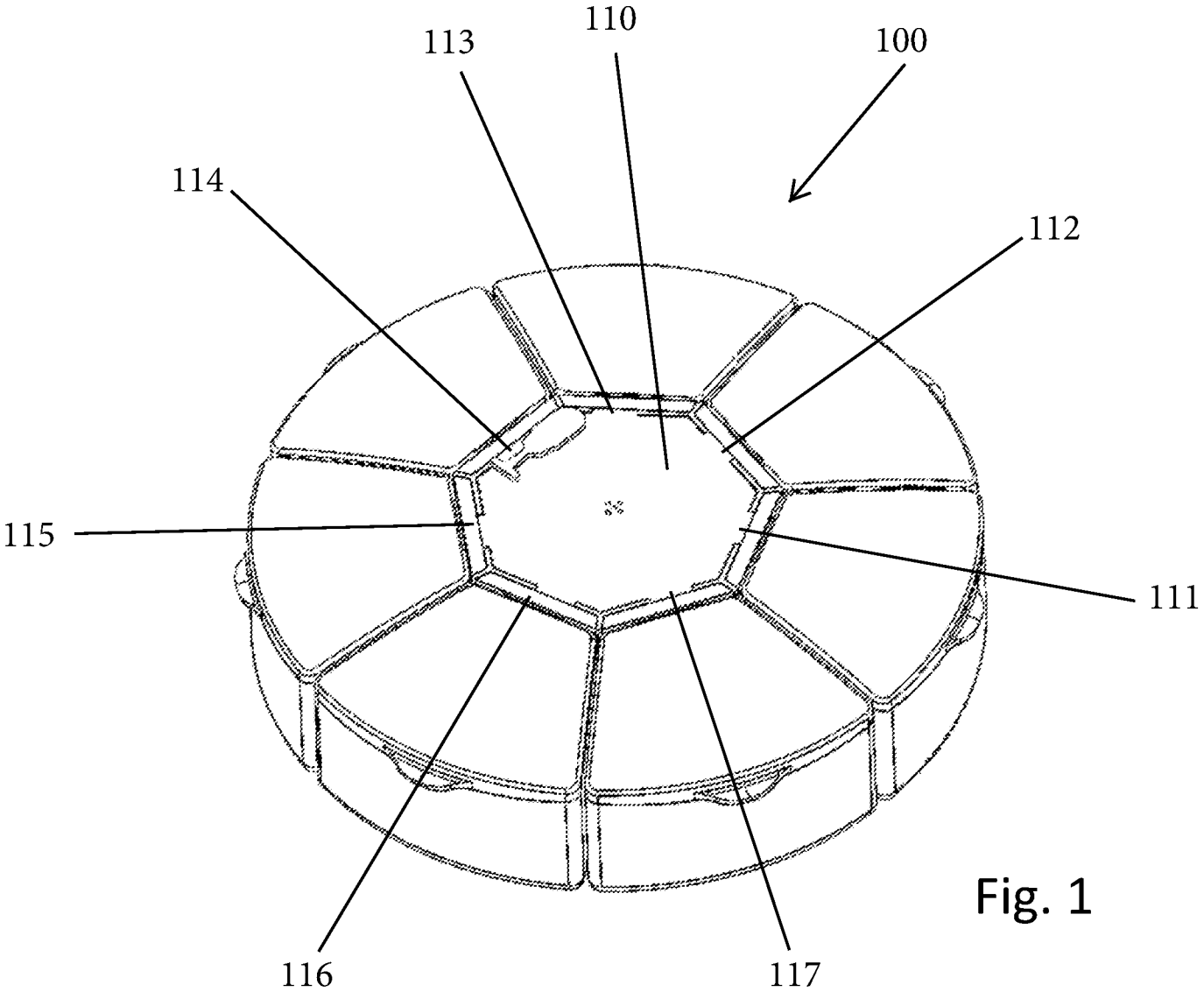
FIG. 1 is a top and side perspective view of a dispensing apparatus according to one embodiment.
Figure 2:
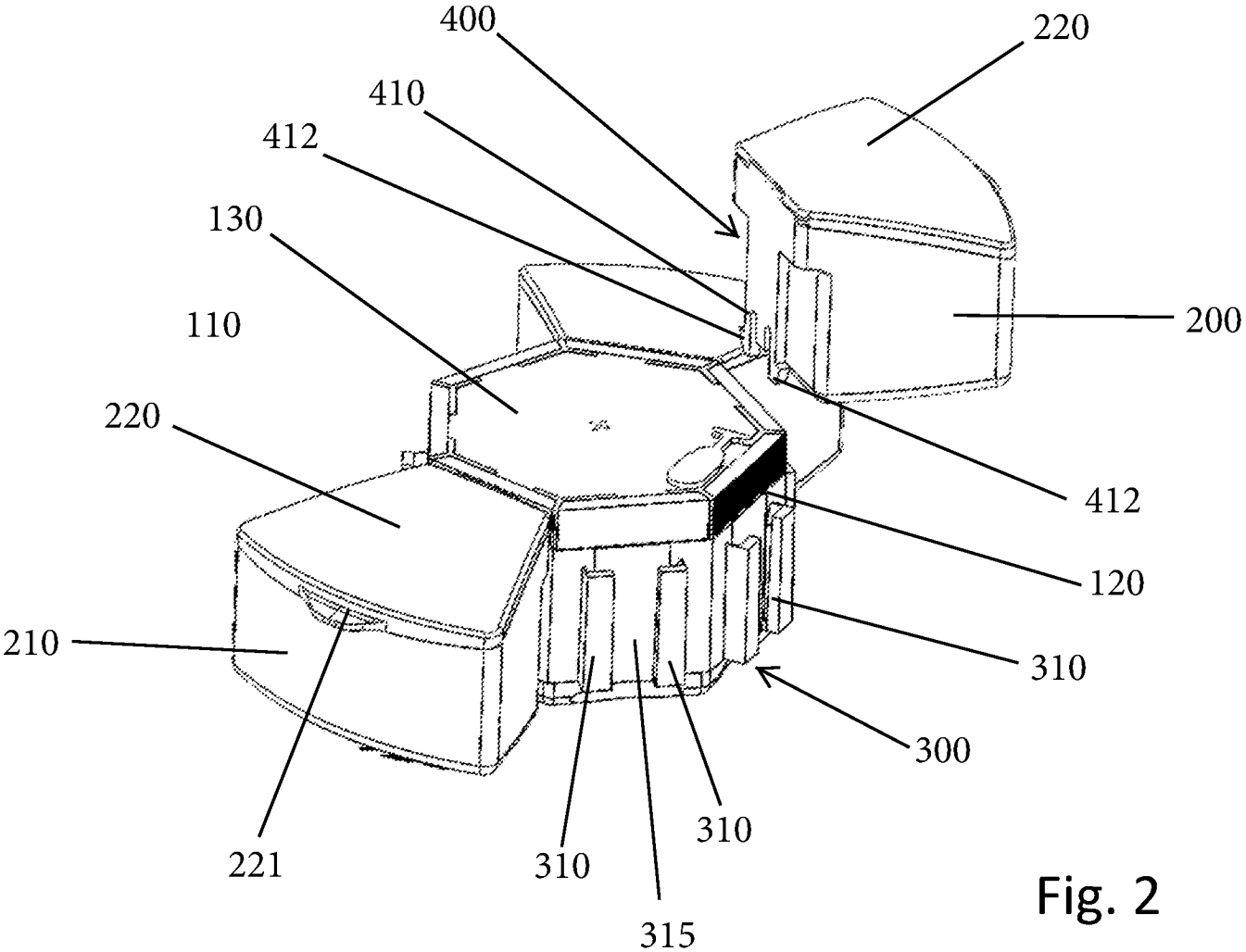
FIG. 2 is an exploded view of the dispensing apparatus showing a hub with one cartridge attached to the hub and one cartridge detached from the hub.
Figure 3:
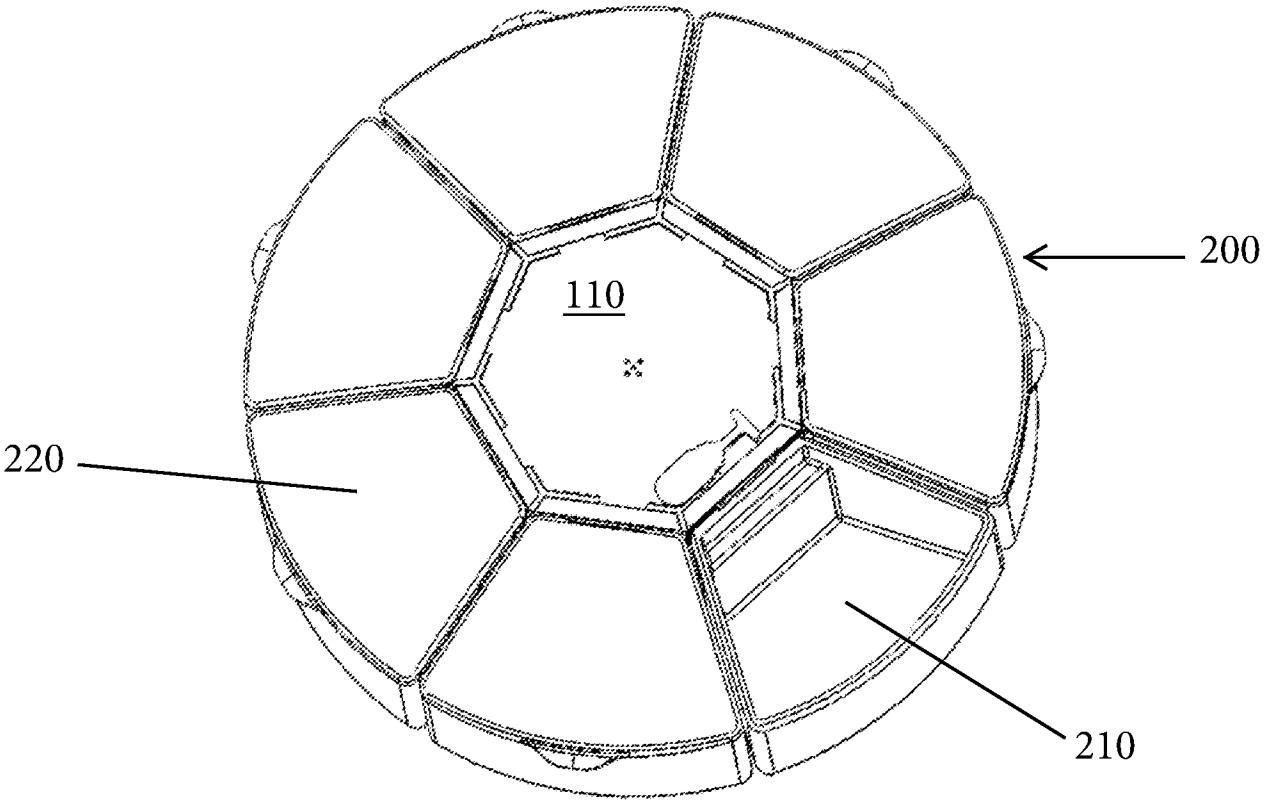
FIG. 3 is a top and side perspective view of the dispensing apparatus with one lid removed from one cartridge.
Figure 4:
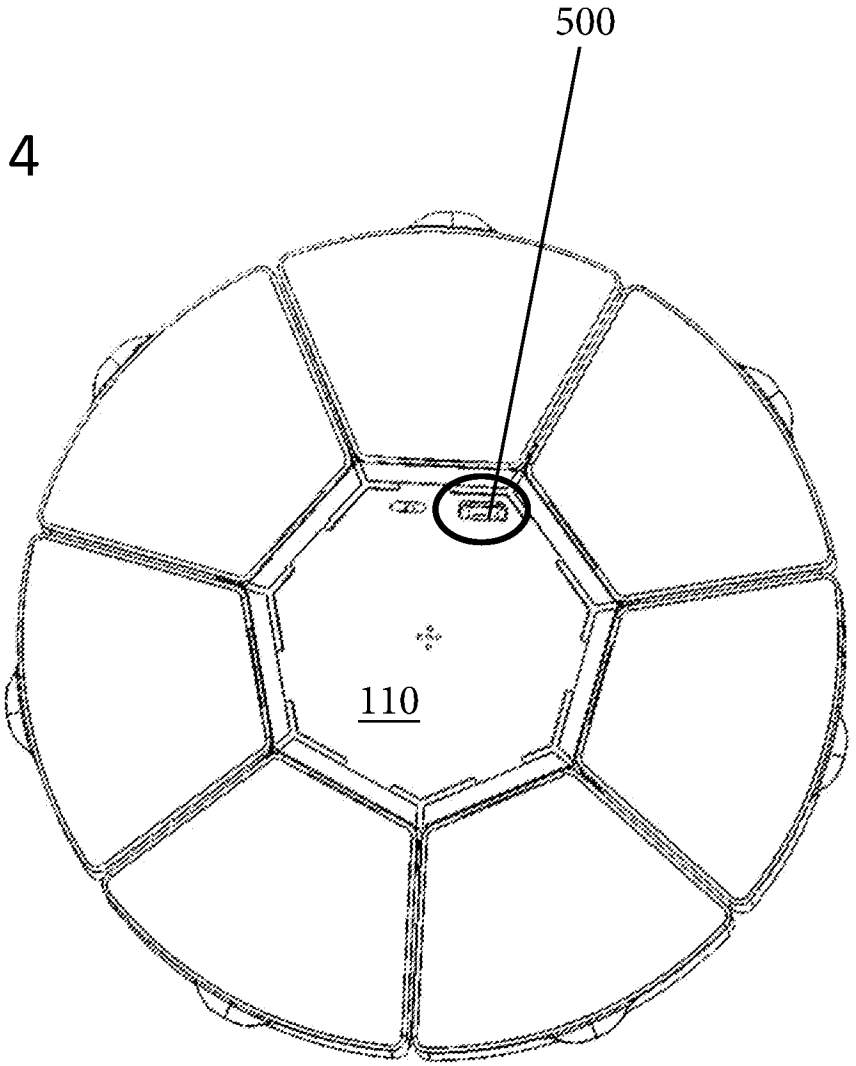
FIG. 4 is a top plan view of the dispensing apparatus showing a top plan view thereof.
Figure 5:
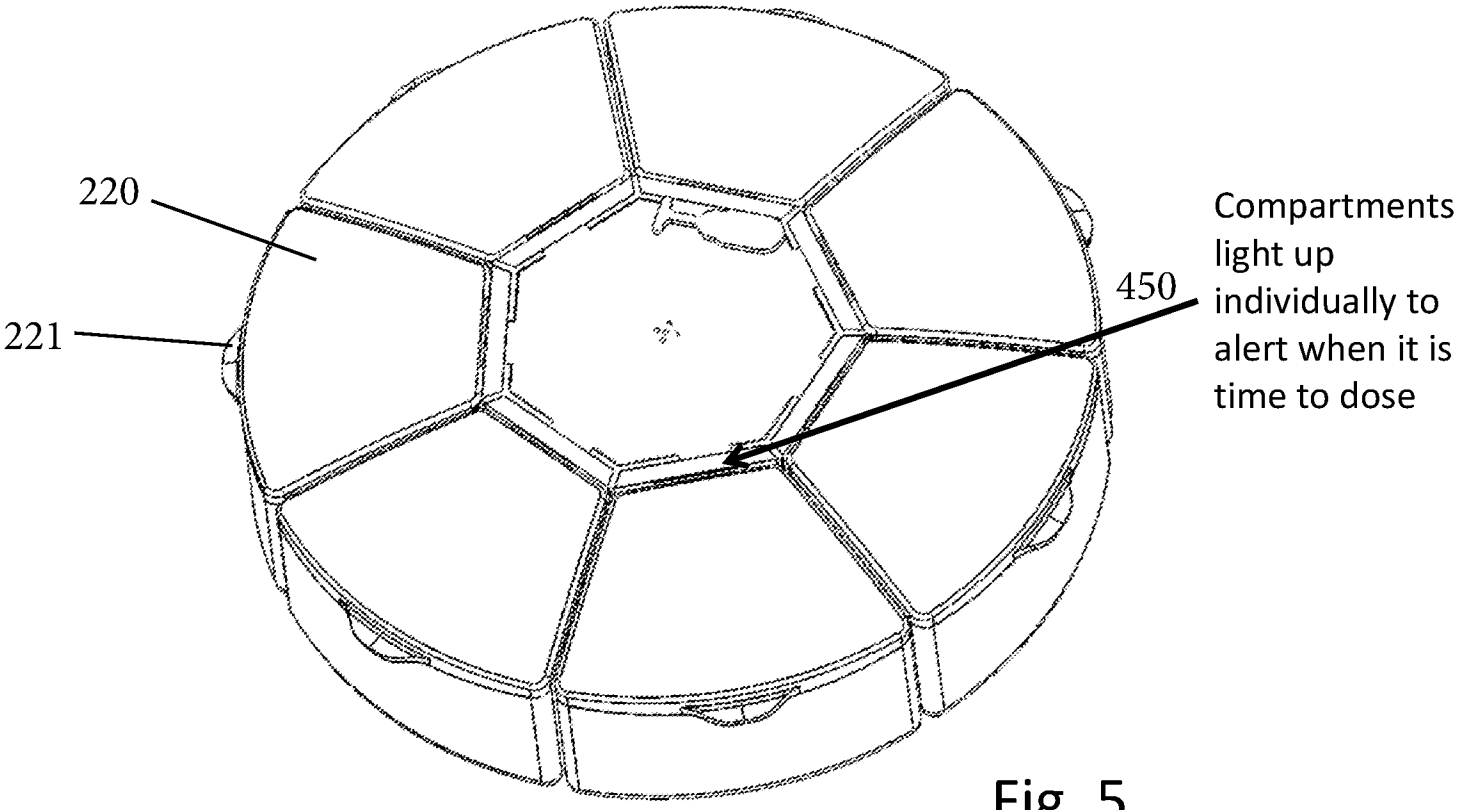
FIG. 5 is a top and side perspective view of the dispensing apparatus illustrating individual light indicators for each cartridge.
Figure 6:
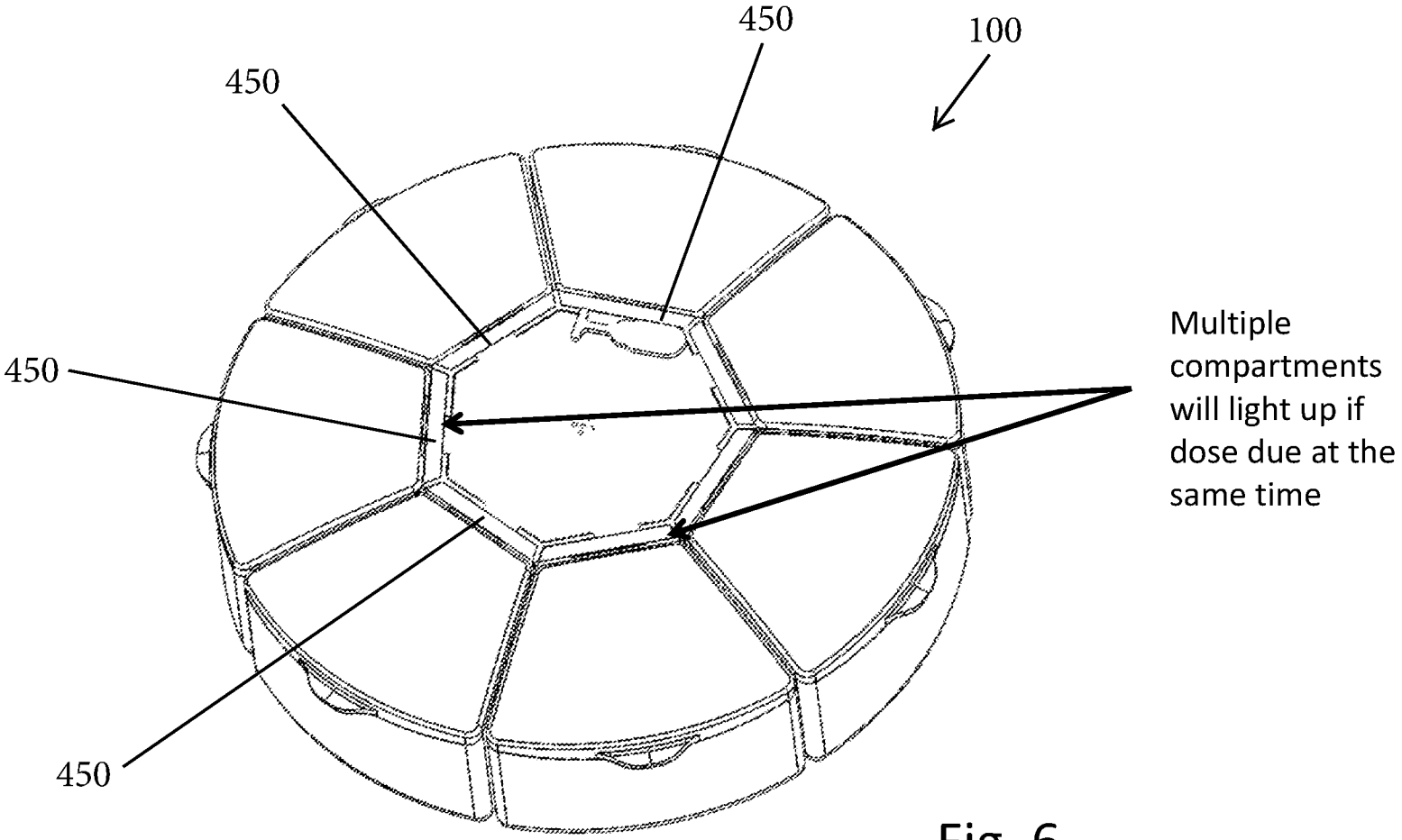
FIG. 6 is a top and side perspective of the dispensing apparatus illustrating illumination of light indicators for multiple cartridges.

As shown in the figures, dispensing apparatus 100 is provided and is configured for dispensing articles, such as pills. As described herein, the dispensing apparatus 100 is configured to have a modular design in that it includes a plurality of containers that hold articles and can be of a disposable nature and are removable and interchangeable.

The dispensing apparatus 100 includes a main unit or base 110 that can be in the form of a center hub.

It will be appreciated that the center hub 110 can be formed to have any number of different shapes including a hexagon or heptagon (as illustrated). The center hub 110 is thus defined by a plurality of sides that meet one another along vertical edges (vertices). In the illustrated embodiment, the center hub 110 includes a first side 111, a second side 112, a third side 113, a fourth side 114, a fifth side 115, a sixth side 116, and a seventh side 117. It will be appreciated that the hub 110 can have any number of different shapes including polygons or even a circle defined by a single continuous curved outer wall.

The center hub 110 is a hollow structure and is configured to contain electronics, such as a processor, and a power source, such as batteries. As described herein, the center hub 110 also includes a light source which can be in the form of a plurality of lights (LEDS) that are associated with the individual sides of the center hub 110. The center hub 110 can thus include a base or housing 120 and a removable cover 130. The cover 130 can be joined to the base 120 using traditional techniques, such as a mechanical attachment (e.g., snap-fit or friction fit).

In one embodiment, the cover 130 can include one or more displays, such as one or more digital screen, that can be controlled with a user interface, such as a touchscreen.

Thus, instead of LEDs that are oriented along the sides of the hub 110, there can individual digital displays along the sides for each respective cartridge or there can be a single large digital screen that is shaped complementary to the shape of the hub so that the digital display has regions that are adjacent the cartridges. In this way, instructions, prompts and alerts and other information can be displayed. The hub 110 can also incorporate a speaker to remind or speak to the user and voice recognition facial recognition or other biometric software to control the hub 110. The user can thus use voice commands to control operation and to log data and get stored information.

The center hub 110 can be configured such that each side 111, 112, 113, 114, 115, 116, 117 can support a cartridge 200 that is detachably attached thereto. The plurality of cartridges 200 are intended to each hold a plurality of articles, such as pills, and each can be opened and closed individually. In the event that the center hub 110 is circular in shape, each of the cartridges 200 can have an arcuate shape with an inner wall being curved and interfacing with the curved outer wall of the center hub 110. The arcuate length of the different cartridges 200 can differ in that some cartridges can have greater arcuate lengths relative to others.

The cartridges 200 are thus modular cartridges that are configured to mate and be attached to one side wall of the center hub 110. More particularly, each side (wall) 111, 112, 113, 114, 115, 116, 117 includes a first coupling member 300 that is configured to mate to a second coupling member 400 for detachably coupling the cartridge 200 to the center hub 110. Any number of different techniques can be used to attach the cartridge 200 to the center hub 110. In the illustrated embodiment, the first coupling member 300 is in the form of a pair of spaced rails 310 that define a slot 315 therebetween. Each of the first coupling members 300 comprises an L-shaped rail with one leg facing inward toward one leg of the other L-shaped rail so as to define a receiving slot that receives the cartridge 200.

The second coupling member 400 is formed along an inner side wall of the cartridge 200. The second coupling member 400 can be in the form of a downwardly depending protrusion (arm) that has a pair of flexible locking tines 410. Each locking tine 410 includes a locking hook 412 at the end of the locking tine 410.

The second coupling member 400 is inserted into the slot 315 between the spaced rails 310 and the locking tines 410 initially flex inward as a result of the locking hooks 412 seating against the inner surfaces of the spaced rails 310. The locking hook 412 includes a beveled cam surface that facilitates the insertion of the second coupling member 400 into the slot 315 since the cam surface initially contacts the inner surface of the spaced rails 310 and causes the inward flexing of the tines 410. Once the locking hooks 412 clear the bottom ends of the spaced rails 310, the locking tines 410 flex outward (due to natural biasing forces) and the hooks 412 engage the ends of the spaced rails 310 and thereby detachably lock the cartridge 200 in place. To detach the cartridge 200, the process is simply reversed and the hooks 412 are pushed inward toward one another to cause disengagement with the ends of the spaced rails 310 and the cartridge 200 is then pushed upward with the hooks 412 sliding along the inner surfaces of the spaced rails 310. Once the cartridge 200 clears the spaced rails 310, the cartridge 200 can be freely disengaged from the center hub 110.

Figure 8:
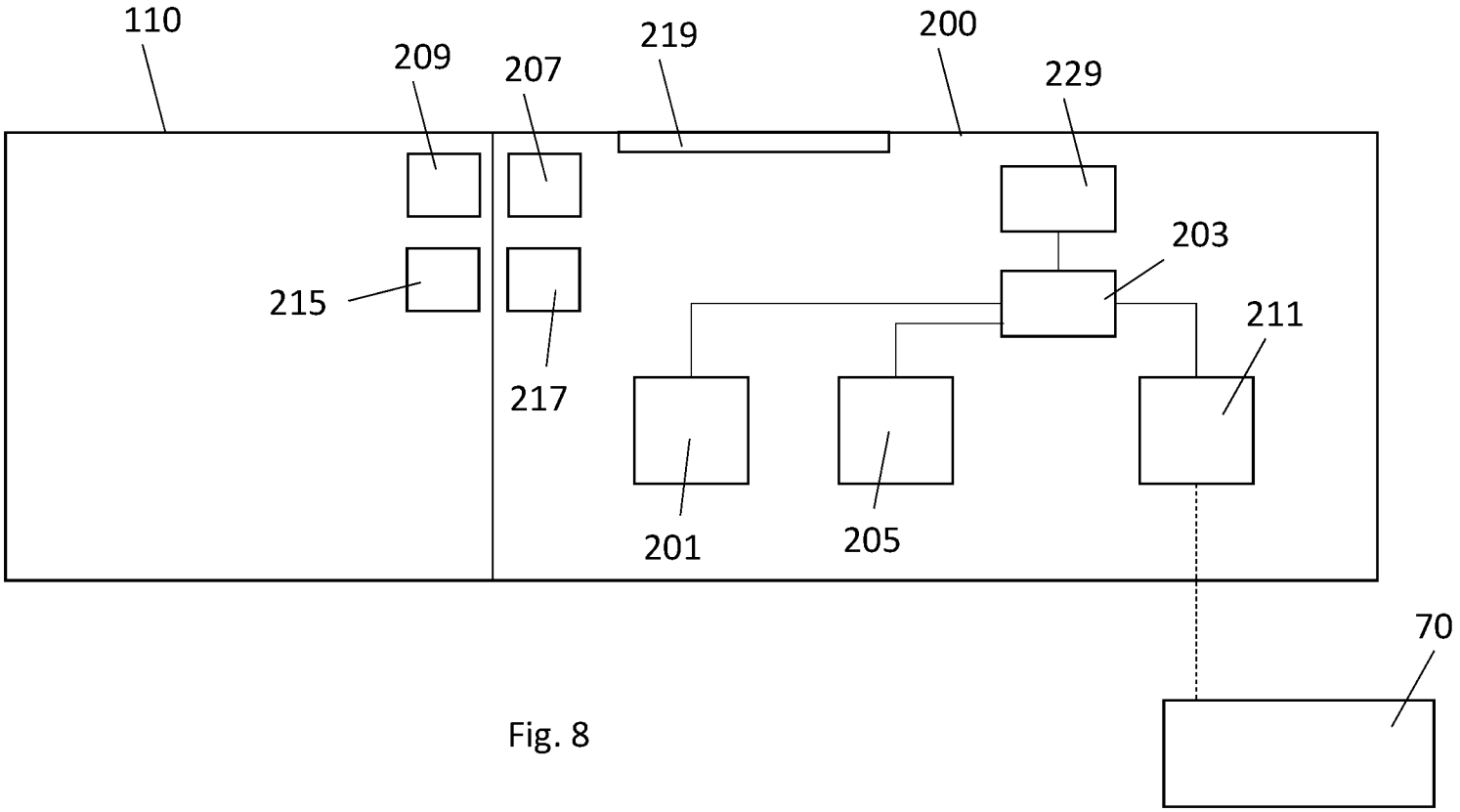
FIG. 8 is a schematic illustrating parts of another exemplary dispensing apparatus.
Figure 9:
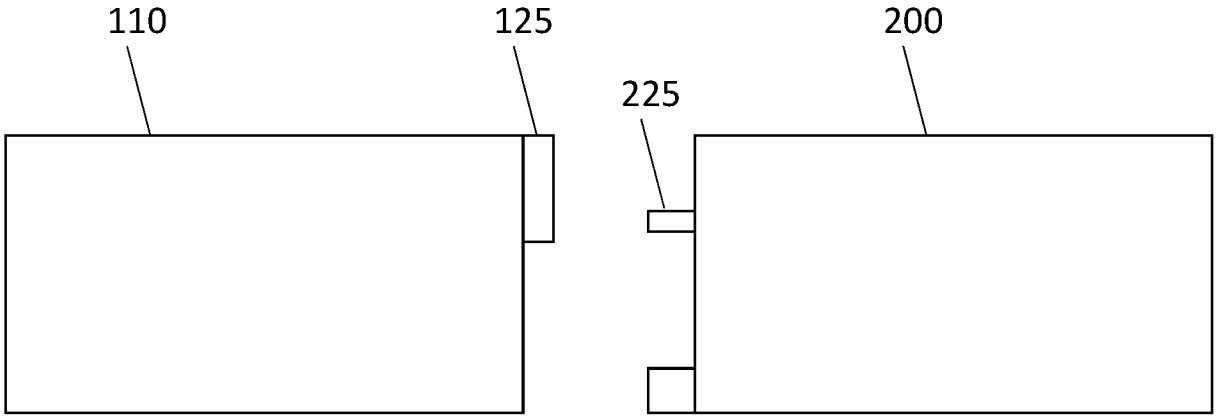
FIG. 9 is a schematic showing another means for detachably coupling the cartridge to the hub.

It will be appreciated that the above-described coupling mechanism is only exemplary in nature and other techniques can be used to detachably attach the cartridge 200 to the hub 110. Broadly, the cartridges 200 are detachably coupled to the hub 110 and can be disposable. For example, any number of mechanical coupling techniques can be used or other techniques. For example, fasteners can be used such as hook and loop material that allows the cartridge 200 to be attached to one side of the hub 110. Other techniques include, as shown in FIG. 9, the provision of a post or nub 225 on one of the cartridges 200 and the hub 110, while the other has an upside-down U-shaped slot formed in an external wall structure 125 which receives the post 225 to secure the cartridge 200 to the hub 110 in a detachable manner. Besides mechanical fasteners, bonding agents and the like can be used. In addition, magnets can be used to detachably attach the cartridges 200 to the hub 110 by providing pairs of magnets with one set attached to the side walls of the hub 110 and another set attached to the inner walls of the cartridges 200. For example, magnets, such as at locations 215, 217 in FIG. 8, can be used.

In yet another embodiment, the cartridges 200 can be fixedly attached to the center hub 110 and not removable by the user. The cartridges 200 can still be modular in nature and can be assembled to the center hub 110 but the attachment to the center hub 110 can be of an irreversible type and the user cannot detach the cartridge 200 after assembly.

An identification system can be established between the center hub 110 and the cartridges 200. For example, each side (external side wall) of the center hub 110 can include unique identification indicia, such as a number or a letter, and each cartridge 200 includes corresponding matching indicia. For example, for the hexagonal shaped center hub 110 shown in FIG. 1, side 111 includes first indicia (e.g., #1)(not shown); side 112 includes second indicia (e.g., #2) (not shown); side 113 includes third indicia (e.g., #3) (not shown); side 114 includes fourth indicia (e.g., #4) (not shown), side 115 includes fifth indicia (e.g., #5) (not shown), side 116 includes sixth indicia (e.g., #6) (not shown), and side 117 includes seventh indicia (e.g., #7) (not shown). The corresponding cartridges 200 are thus each individually numbered #1 to #7 and the user is easily guided to place one cartridge, such as cartridge #1, in its corresponding location along one side of the center hub 110, in this case side 111 which includes indicia #1.

The cartridge 200 includes a hollow body 210 that holds the articles and includes a lid 220 that can be opened and closed. The lid 220 can be of a type that can be fully removed (detached) from the hollow body 210 or can be of the type that is hingedly connected to the hollow body 210. While the illustrated embodiment shows the cartridges 200 having the same shape and size, it will be appreciated that one or more of the cartridges 200 can have a different shapes and/or size.

The lid 220 can include a tab or lip 221 that allows the lid 220 to be easily lifted and opened.

Instead of a lid 220, a door can be used such as a door at the outer wall of the cartridge 200.

Each cartridge 200 can include a magnet that can be sensed by a sensor that is part of the center hub 110 and therefore, a detection process is provided whereby the opening/closing of the lid can be tracked and recorded. Thus, the mechanism for sensing whether the lid 220 is open or closed involves the use of a magnet; however, it will be appreciated that other techniques can be used to sense whether the lid 220 is open or closed. For example, a switch can be incorporated into the lid or the hub such the opening of the lid closes the switch and alerts the processor that the lid has been opened. The timer can log this event. Other techniques, include the use of a light sensor (optics reader)

or a weight detector or any other means in which it can be determined when the lid 220 is opened or contents removed.

Each cartridge 200 is intended to hold one type of article, such as one type of pill. While traditional pill boxes store pills by day of the week and comingle different types of pills in one cell associated with one day of the week, the modular design of the apparatus 100 of the present invention permits accommodation for expanding disposable cartridges depending on the drug supply, 30-days, 7-days, 90-days, etc. That said, some users may still opt to use the heptagon version as a 7-day organizer and place multiple different articles in each cartridge and sort instead by day of the week, or a 30-day geometry with 30 cartridges and store instead by day or the month, etc.

In yet another embodiment, each cartridge 200 can be associated with one day of the week and thus, when there are seven cartridges, the first cartridge can represent Monday's medication; the second cartridge can represent Tuesday's medication; the third cartridge can represent Wednesday's medication; the fourth cartridge can represent Thursday's medication; the fifth cartridge can represent Friday's medication; the sixth cartridge can represent Saturday's medication and the seventh cartridge can represent Sunday's medication. In this way, the user is alerted to open and take one day's medication contained within a single cartridge. The device can thus act as a Sunday-Monday organizer. It will be appreciated that the different cartridges can include different medications since some medications are not dispensed every day.

The center hub 110 can thus store information about when each cartridge 200 opens/closes since each disposable cartridge 200 can have a magnet that actuates the corresponding hub position allowing the processor of the center hub 110 to store the history of openings and closings of each cartridge 200.

In addition, one or more safety features can be provided. For example, the center hub 110 and/or cartridge 200 can include light feedback that serve to alert the user that the medication is being taken on time or out-of-schedule. As mentioned, the processor of the center hub 110 store's the patient medication regimen (dispensing schedule) and the center hub 110 knows which medications are in which cartridges and therefore, the center hub 110 (and/or cartridge 200) can be provided with lights associated with each cartridge 200. For example, on each side of the center hub 110, there can be at least one light 450 that is associated with the cartridge 200 that is coupled to that side. The light can be configured to turn different colors to guide the user. For example, if someone open a cartridge 200 out-of-schedule, the light can illuminate in a red color to indicate to the user that the pill is not being taken according to schedule. Conversely, if the cartridge 200 is opened according to the dispensing schedule, the light can illuminate in a green color to indicate a timely opening of the proper cartridge 200. This feature is shown in the figures. In addition, the figures show that multiple cartridges 200 can light up if a dose is due at the same time. In this way, the center hub 110 provides dispensing alert information that prompts the user to open the proper cartridge(s) 200.

Thus, the light 450 can include multiple colors for different signals.

The device 100 can communicate via cellular connectivity, WIFI, Bluetooth or any other radiofrequency technology available to a central cloud-based system to monitor activity. In this way, the activity of a patient can be monitored and recorded.

As shown in the figures, the center hub 110 can be charged and/or programed via a USB port 500; however, other types of charging and power sources can be used.

It will be understood that the cartridges 200 can be of a disposable type and can come pre-filled with medication and are then simply paired with the central hub 110. Part of the initialization and pairing process can also involve utilizing a program (such as an app) that allows the cartridge 200 to be paired to one location of the central hub 110. The dispensing schedule is also programmed into the processor of the central hub 110. The pairing of the cartridges 200 to the central hub 110 allows the integration of the entire dispensing schedule for a particular patient.

As discussed it is within the scope of the present invention that the hub 110 can have different shapes and the cartridges 200 can have different shapes and/or sizes that can mate to the hub 110. The present invention is thus broadly speaking an apparatus that has a center hub with a plurality of cartridges that are detachable from the center hub and surround the center hub.

Figure 7:
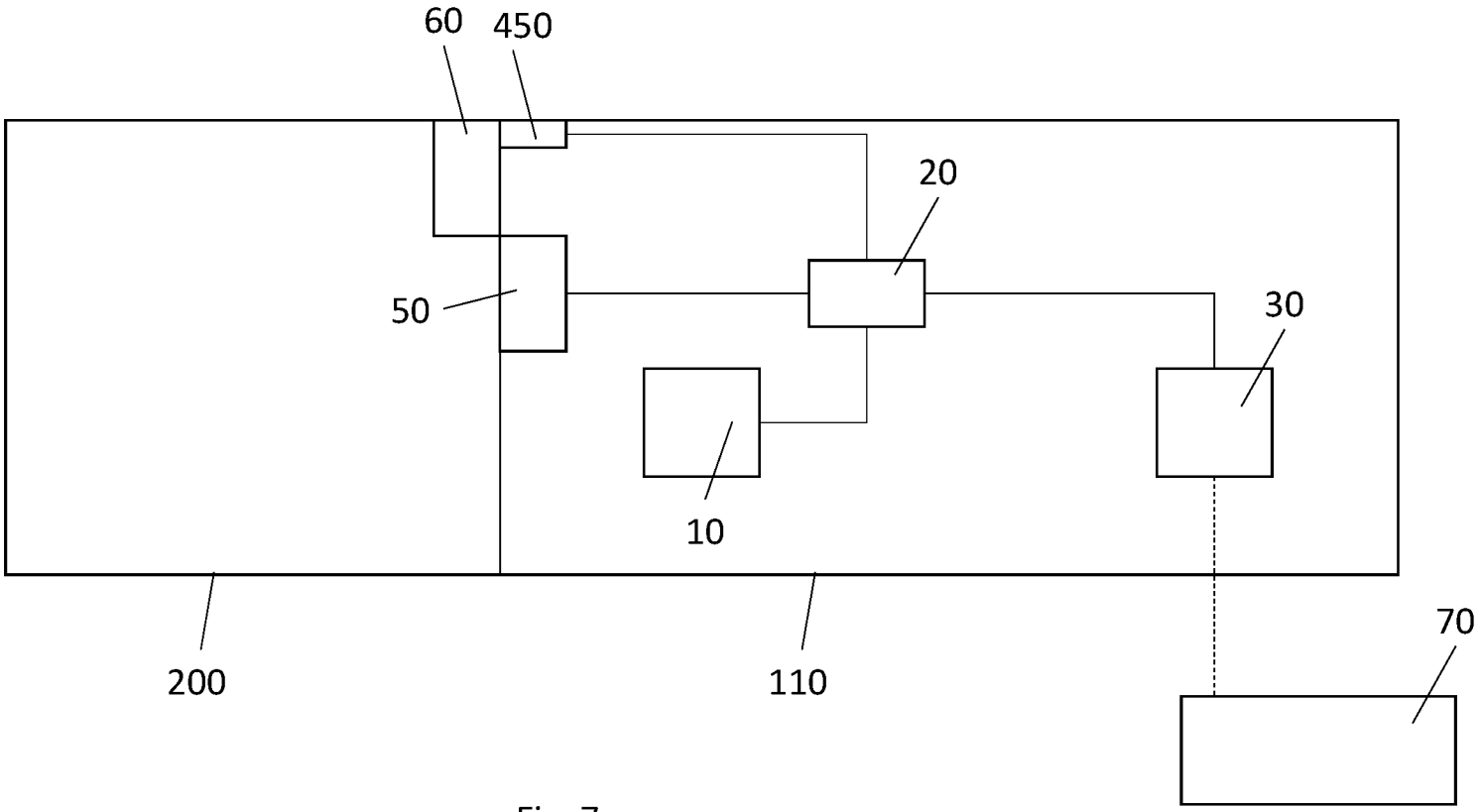
FIG. 7 is a schematic illustrating parts of one exemplary dispensing apparatus.

FIG. 7 is a schematic showing the electronics and other components of the hub 110. In particular, the hub 110 can include a power source 10, which can be in the form of one or more batteries container in a compartment, a processor (PCB) 20 powered by the power source 10 and operatively connected to the other components (electronics). Memory is also provided in the hub. The power source 10 can be charged using the micro USB port 500. The electronics also can include a timer 40 for keeping track of dispensing times and the like. A sensor 50 is provided which in combination with magnet 60 of the cartridge 200 allows the opening and closing of the cartridge lid to be detected, tracked and stored in memory, etc. A communications module 30 is provided to allow for communication with an external device 70, such as a computing device, tablet, smartphone, etc. As described herein, the communications module 30 allows for data to be freely transferred between the hub 110 and the external device 70. This allows not only the patient but also other personal, such as a doctor, to monitor whether the patient (user) is complying with the prescription.

In one or more implementations disclosed herein, the patient (user) can be provided with an at-home personal medication prescription mobile application (mobile app) for use on a patient's mobile device. The mobile app allows for alerts to be sent to the user as when an alert is sent to alert the user to take a medication and also personal reporting information can be provided in which the user can easily track dosage intakes, missed or remaining doses and even a personal score or grade to reward a user that fully complies to the prescription regimen.

The cartridges 200 are thus modular in design and thus, different sized cartridges with the same hub 110 can expand the capacity of the apparatus 100. Each cartridge 200 is designed to hold a high supply of a majority of pill sizes while maintaining unit mobility (the entire unit (apparatus 100 in the figures presented) has a diameter of about 5 inches and a height of about 1 inch in one embodiment). Individualized cartridges 200 prompt patient at the right day/time as by light indicator 450. The compartments of the cartridges 200 can store up to 90 day supply of some medications (in one embodiment, the compartment volume of the cartridge 200 can be about 2.5 cube inches per compartment). It will be appreciated that the above dimensions are not limiting and are only exemplary.

While the apparatus 100 is described as dispensing medication (e.g., pills or tablets), it will be appreciated that other types of articles can be dispensed.

In yet another aspect, an alert or warning system is provided for alerting the user that an incorrect mating between the cartridge 200 and one of the respective receiving sides (docks) of the hub 110.

The act of one cartridge 200 mating with the hub 110 can be thought of as a docking action in which the cartridge 200 docks with the hub 110 which can be thought of as being a home or base station. In one embodiment, each cartridge 200 has a respective home docking station which can be defined as being one side of the hub 110 at which the cartridge 200 mates. The cartridges 200 can include unique identifiers that are read by the hub 110 so as to ensure that the proper cartridge 200 is received within the proper dock of the hub 110. In the event a cartridge 200 is not docked in the correct station, the user can be notified. For example, visual or audio alerts can be sent to the user as for example by a light (e.g., light 450) associated with one of the hub 110 and/or the cartridge 200 or via a digital display screen. One type of identifier can be a unique identifier, such as a bar code or RFID code, and a reader for reading the identifier. Alternatively, the cartridges 200 can be identified by way of magnets or similar techniques. In FIG. 8, a first identifier element 215 is part of the hub 110, while a second identifier element 217 is part of the cartridge 200. The second identifier element 217 can be a unique identifier that identifies this specific cartridge 200 and the first identifier element 215 can be configured to read the second identifier element 217. The reverse can be true in that the reader could be installed in the cartridge and the hub can include the unique identifier.

In one embodiment, the second identifier element 217 can consist of one or more magnets at a specific location along the inner wall of the cartridge 200 and the first identifier element 215 is a sensor for detecting the presence of the one or more magnets (as by detecting magnetic field). It will be appreciated that the cartridges 200 can all have unique identifiers by simply placing the magnets in different locations along the inner wall or other location of the cartridges. In this way, if for the first cartridge 200 that is for insertion in dock station 1, the second identifier element 217 is located in zone 1, the corresponding first identifier element 215 on the hub is looking for the second identifier element 217 in zone 1 and thus, if another cartridge is placed by accident in dock station 1, the second identifier element 217 will not be in zone 1 and the first identifier element 215 will not be able to sense/detect/read the second identifier element 217. An error message or alert can be generated that indicates an improper docking of the cartridge 200. Thus, to uniquely identify the cartridges 200, one or more magnets can be placed in different zones of the inner wall of the cartridge and/or multiple magnets can be used in one zone as opposed to a single magnet and the detector (sensor) will detect different levels of magnetic fields as a fingerprint for the cartridge. In addition, an optic reader scheme can be used in which an optic marker, such as a black dot (at location 217) can be placed in a specific zone of the cartridge inner wall and the optic reader (at location 215) can detect the presence or absence of the dot as a way to detect whether the proper cartridge is docked in proper docking station. The black dots will be in different locations for the different cartridges and the reader for a specific docking station will be looking for the dot in the select location. Alternatively, the identifiers can all be in a common zone but the identifier itself is unique, such as a bar code and the like.

Any type of detection mechanism can be used to detect whether the proper cartridge is docked at the correct docking station. For example, the mechanical connection between the cartridge and hub can be configured so that only one cartridge can mate with its corresponding docking station. For example, the types and/or locations of the pairs of coupling members that establish the detachable connection can be in different locations so that if an attempt to dock the wrong cartridge to one docketing station, the cartridge will simply not fit right due to misaligned coupling members (e.g., the slot and locking tines misalign, etc.).

In yet another embodiment, shown in FIG. 8, the cartridge 200 itself can contain electronics, etc. More specifically, the cartridge 200 can include a power source 201, which can be in the form of one or more batteries container in a compartment, a processor (PCB) 203 powered by the power source 201 and operatively connected to the other components (electronics). Memory is also provided in the cartridge 200. The power source 201 can be charged using a micro USB port, such as port 500. The electronics also can include a timer 205 for keeping track of dispensing times and the like. A detection mechanism is provided for detecting whether the cartridge 200 is properly docked to the hub 110. For example, a first detector element 207 can be associated with the cartridge 200 and a second detector element 209 can be associated with the hub 110 (any of the detection schemes described herein can be used). In addition, means for detecting whether the cartridge lid is open or closed can be provided and comprise any of the means described herein. The cartridge 200 can include a communications module 211 is provided to allow for communication with the external device 70, such as a computing device, tablet, smartphone, etc. As described herein, the communications module 211 allows for data to be freely transferred between the cartridge 200 and the external device 70. This allows not only the patient but also other personal, such as a doctor, to monitor whether the patient (user) is complying with the prescription.

In the embodiment of FIG. 8, it will be appreciated that the cartridge 200 can be removed from the hub 110 taken with the user and then later redocked (e.g., by sliding it back onto hub) and it automatically pairs the logs of the day for that cartridge 200. For example, the stored data in the memory of the cartridge 200 is then transferred to the hub 110. It will be appreciated that the communications module 211 can be configured to only send data to the hub 110 as opposed to the external device 70 and instead, the data after being transmitted to the hub 110 can be transferred to external device 70 from the hub 110.

In addition, as mentioned herein, the cartridge 200 can include a digital display 219 (FIG. 8) and also can include a user interface, such as a touch screen or buttons, etc. In this way, each unique cartridge 200 can be programmed and/or commands can be inputted. The display 219 can be located along the top of the cartridge lid or can be located along the outer wall of the cartridge 200.

In one embodiment, instead of the cartridge lid being freely openable to access the contents, the cartridge 200 can incorporate a dispensing mechanism in which the lid or door only opens within a select dispensing window determined by the user's dispensing schedule. A locking mechanism can thus be incorporated into the cartridge 200 or the hub 110 so that the lid or door is only unlocked at the select dispensing times and all other times, the door is locked to prevent opening. For example, an electro-mechanical mechanism, such as a pin and solenoid can be provided in the cartridge and/or hub, and when energized, the solenoid causes the pin to move into a locked position in which the pin engages or otherwise obstructs the lid or door and prevents the opening thereof. Other types of locking mechanisms are equally possible. In this way, dose control is incorporated into the device and compliance to the dispensing schedule is maintained. In FIG. 8, the locking mechanism is illustrated at 229 and is in communication with processor 203 for control over the locking mechanism 229.

In yet another aspect, the cartridges 200 and/or hub 110 can be activated by biometrics, such as a fingerprint, voice, face recognition, iris recognition, etc. This information can be inputted using a touch screen that is located along the top of the hub 110 to confirm the identity of the user and provide access. As mentioned, the top of the hub can have a digital display (touch screen) ad/or other user interface features, such as controls (buttons, switches, etc.) that allow for user input.

Thus, the feedback loop to patients can be in the form of visual identifiers (lights 450) and audio (e.g., beeping noises) and can also include voice interactivity in that a voice can announce when it is time to take a given medication and can alert the user which cartridge should be accessed along with other relevant information. This voice interactivity can also not only prompt the user to take the medication but can also provide helpful instructions, such as directions of use (i.e., take with food or on an empty stomach) and can also explain why it is important to take the medication within the stated dispensing window, etc. If additional information is desired or needed, the user can use the graphical user interface to access such information which will be displayed on the screen. For example, a pull-down menu can be accessed to allow user selection and user input.

It is to be further understood that like numerals/lettering in the drawings represent like elements through the several figures, and that not all components and/or steps described and illustrated with reference to the figures are required for all embodiments or arrangements. Further, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "including," "comprising," or "having," "containing," "involving," and variations thereof herein, when used in this specification, specify the presence of stated features, integers, steps, operations, elements, and/or components, but do not preclude the presence or addition of one or more other features, integers, steps, operations, elements, components, and/or groups thereof.

It should be noted that use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

The subject matter described above is provided by way of illustration only and should not be construed as limiting. Various modifications and changes can be made to the subject matter described herein without following the example embodiments and applications illustrated and described, and without departing from the true spirit and scope of the present invention.

What is claimed is:

1. A modular dispensing apparatus for dispensing articles comprising:

a hub having a plurality of cartridge docking stations; and a plurality of cartridges for holding the articles to be dispensed; each cartridge being detachably coupled to one of the plurality of docking stations of the hub such that the plurality of cartridges surround the hub, each cartridge having an openable lid or door to provide access to an interior compartment of the cartridge for holding the articles;

wherein at least one of the hub and the plurality of cartridges includes electronics for controlling operation of the apparatus;

wherein the hub has a plurality of external side walls, each external side wall defining one docking station for receiving one of the plurality of cartridges resulting in the plurality of cartridges being disposed along an outer periphery of the hub;

wherein each external side wall includes a first coupling member that faces outward; and each cartridge having an inner wall that includes a second coupling member that is configured to mate with the first coupling member for detachably attaching the cartridge to a respective external side wall of the hub;

wherein each of the plurality of external side walls for the hub includes a light band disposed along a top end of each respective external side wall above the respective first coupling member for selective illumination to indicate an event relative to the cartridge that is attached to the respective external side wall, the plurality of cartridges being located radially outward from the light bands disposed along the plurality of external side walls.

2. The apparatus of claim 1, wherein each cartridge is detachably coupled to the hub by a mechanical connection.

3. The apparatus of claim 1, wherein each external side wall of the hub and each cartridge includes a magnet for magnetically attaching each cartridge to a respective docking station.

4. The apparatus of claim 2, wherein the mechanical connection comprises: (1) a pin disposed on one of the cartridge and the external side wall of the hub and (2) a slot formed on the other of the cartridge and the hub for receiving the pin in sliding action so as to securely couple the cartridge to the hub.

5. The apparatus of claim 1, wherein the hub has a heptagon shape with seven external side walls and there are seven cartridges that mate with the hub.

6. The apparatus of claim 1, wherein each cartridge snap-fits to the center hub as a result of the first coupling member and the second coupling member generating a snap-fit between the cartridges and the hub.

7. The apparatus of claim 1, wherein the first coupling member has a pair of spaced rails formed along an outer surface of each of the plurality of side walls, the second coupling member being a pair of flexible tines that terminate in hooks, the flexible tines being spaced apart so as to permit reception within a center slot defined between the pair of spaced rails and in an engaged position, the hook members engage bottom ends of the spaced rails.

8. The apparatus of claim 1, wherein the event comprises an alert that is it time to dispense one or more articles contained within the cartridge.

9. The apparatus of claim 1, wherein the electronics comprise a power source, a processor, a timer, and a communications module that is configured to receive and transmit data to an external device.

10. The apparatus of claim 1, further including a detector for detecting whether the lid of the cartridge is in an open position or closed position.

11. The apparatus of claim 10, wherein the lid has a magnet coupled thereto and the electronics are contained in the hub and include a sensor that senses a position of the magnet to determine whether the lid is opened or closed.

12. The apparatus of claim 1, further including a detector for detecting whether each cartridge is located within its respective designated docking station.

13. The apparatus of claim 12, wherein the detector comprises a unique identifier that is part of the cartridge and serves to uniquely identify the cartridge and the hub includes a sensor or reader for detecting a presence of the unique identifier and the electronics are configured to alert a user in an event that one cartridge is docked at an incorrect docking station.

14. The apparatus of claim 1, wherein the articles comprise medication pills or tablets.

15. A modular dispensing apparatus for dispensing articles comprising:

a hub having a plurality of cartridge docking stations; and a plurality of cartridges for holding the articles to be dispensed; each cartridge being detachably coupled to one of the plurality of docking stations of the hub such that the plurality of cartridges surround the hub, each cartridge having an openable lid or door to provide access to an interior compartment of the cartridge for holding the articles;

wherein at least one of the hub and the plurality of cartridges includes electronics for controlling operation of the apparatus;

wherein each cartridge is detachably coupled to the hub by a mechanical connection;

wherein the hub has a plurality of external side walls, each external side wall defining one docking station; and wherein each side wall includes a first coupling member that faces outward; and each cartridge having an inner wall that includes a second coupling member that is configured to mate with the first coupling member for detachably attaching the cartridge to a respective external side wall of the hub;

wherein the first coupling member has a pair of spaced rails formed along an outer surface of each of the plurality of side walls, the second coupling member being a pair of flexible tines that terminate in hooks, the flexible tines being spaced apart so as to permit reception within a center slot defined between the pair of spaced rails and in an engaged position, the hook members engage bottom ends of the spaced rails;

wherein the hooks protrude outwardly from the tines and wherein each rail has an L-shape defined by a first leg attached to the hub and a second leg formed perpendicular to the first leg, the second legs facing inward toward one another, wherein the inner wall of the cartridge has a T-shape with the plurality of tines depending downward and defining a bottom portion of one leg of the T-shape, wherein the plurality of tines are configured to flex inward when the tines are inserted into a top end of the pair of spaced rails, each hook including a cam surface that causes inward flexing of the tines when the cam surfaces contact top ends of the pair of spaced rails resulting in the hooks being forced into the center slot until the hooks clear bottom ends of the pair of spaced rails and flex outward into engagement with the pair of spaced rails.

* * * * *